United States Patent [19]

McCulloch

[11] Patent Number: 4,648,460

[45] Date of Patent: Mar. 10, 1987

[54] FIRE PROTECTION SYSTEM

[75] Inventor: Alister L. McCulloch, Berwick, Australia

[73] Assignee: Chubb Australia Limited, New South Wales, Australia

[21] Appl. No.: 634,622

[22] Filed: Jul. 26, 1984

Related U.S. Application Data

[60] Continuation-in-part of Ser. No. 492,997, May 9, 1983, abandoned, which is a division of Ser. No. 195,211, Oct. 7, 1980, abandoned.

[30] Foreign Application Priority Data

Oct. 12, 1979 [AU] Australia ..... 51725/79
Jul. 26, 1983 [AU] Australia ..... PG0475

[51] Int. Cl.[4] ..... A62C 37/34

[52] U.S. Cl. ..... 169/57; 137/68.2; 169/60; 169/17; 169/20

[58] Field of Search ..... 169/9, 16, 17, 19–21, 169/30, 56–60, 62, 71, 84, 85, 91, 77, DIG. 3; 251/43, 95, 114, 116; 137/68 A, 68 R, 70, 68.1, 68.2; 222/3, 54

[56] References Cited

U.S. PATENT DOCUMENTS

| | | | |
|---|---|---|---|
| 1,035,898 | 8/1912 | Pasman | 251/43 |
| 1,691,710 | 11/1928 | Epps et al. | 169/60 X |
| 2,230,644 | 2/1941 | Horta | 251/43 |
| 4,126,184 | 11/1978 | Hinrichs | 169/66 |
| 4,322,385 | 3/1982 | Goetz | 422/165 |

FOREIGN PATENT DOCUMENTS

| | | | |
|---|---|---|---|
| 131942 | 5/1946 | Australia | 169/57 |
| 806700 | 12/1936 | France | 169/60 |
| 1468118 | 12/1966 | France | 169/19 |
| 1044576 | 10/1966 | United Kingdom . | |
| 1399574 | 7/1975 | United Kingdom . | |
| 1542285 | 3/1979 | United Kingdom . | |

*Primary Examiner*—Andres Kashnikow

[57] ABSTRACT

A fire protection system comprises a fire extinguisher, pneumatically operable actuator on the fire extinguisher for triggering the extinguisher, an elongate tube containing a temperature responsive gas-evolving substance, and a conduit connecting the tube to the actuator for transmitting gas pressure to the actuator. The gas-evolving substance is selected to generate, when the temperature about the tube attains a critical value within a predictable range, a quantity of gas which develops a pressure in the conduit sufficient to operate the actuator.

3 Claims, 6 Drawing Figures

FIRE PROTECTION SYSTEM

This is a continuation in part of co-pending Ser. No. 492,997, filed May 9, 1983, now abandoned, which is a divisional of Ser. No. 195,211, filed Oct. 7, 1980, now abandoned.

This invention relates to a fire protection system which has special utility in relatively harsh environments.

Conventional fire protection system employ detectors sensitive to a prescribed local temperature or temperature gradient, or to the presence of smoke. These detectors tend to be unsuitable for harsh environments, where they are susceptible to high false alarm rates and a relatively short life. Temperature responsive detectors typically include finely spaced contacts which are too readily bridged by water or other contaminants, while smoke detectors are of course reliable only in normally clean atmospheres.

Harsh environments requiring built-in fire protection systems include certain types of machinery such as those operating in the vicinity of potentially flammable materials, such as hydraulic fluid, contained under high pressure. A fire protection system for an application of this kind must not only be hardy and free of susceptibility to false alarm, but should be capable of shutting down or otherwise modifying the machinery or associated equipment in order to at least dampen a detected fire condition.

A known fire protection system, which is disclosed in Australian patent specification No. 131942, employs a pneumatically operable electrical switch. The switch is triggered by a tubular detector housing decomposable gas-evolving material such as a pyrotechnic fuse and itself controls electrical circuitry for operating an alarm or an automatic fire extinguisher, or for preventing overheating in mechanical or electrical equipment. It has now been appreciated that the prior system can be advantageously simplified to attain enhanced reliability of operation at reduced cost.

The invention accordingly provides a fire protection system comprising:

a fire extinguisher;

pneumatically operable actuation means on the fire extinguisher for triggering the extinguisher by releasing extinguishant therefrom; and a detector consisting of an elongate tube containing a temperature responsive solid gas-evolving substance; said tube being of a heat conductive material and located in a zone where the presence of a fire is to be detected;

wherein said tube is coupled to a separate conduit in turn connected to said actuation means for transmitting gas pressure to the actuation means; and wherein said solid gas-evolving substance is selected to suddenly generate, when the temperature about the tube attains a critical value within a predictable range, a quantity of gas which develops a pressure in said conduit sufficient to operate said actuation means.

Said tube may be steel, preferably copper plated and hot tinned, and may be closed at one end by a steel plug welded to the tube. Said solid gas-evolving substance is selected with regard to the rate of response desired, and to the overall volume and pressure requirements of the system. Suitable substances include igniter fuses and nitrocellulose solution which has been poured into the tube and allowed to dry. For fire sensitive purposes, effective gas generation should occur when the temperature about the tube exceeds a critical temperature in the range 150° to 250° C., preferably about 200° C.

The tube may be coupled to the conduit in an arrangement which includes a frangible diaphragm for sealing off the tube. Said conduit may be branched to transmit the gas pressure to other pneumatically operable devices such as electric switches for alarms or rams disposed to modify machinery being protected, such as by closing fuel or air valves or the like.

The invention will be further described, by way of example only, with reference to the accompanying drawings, in which.

Figure 1:
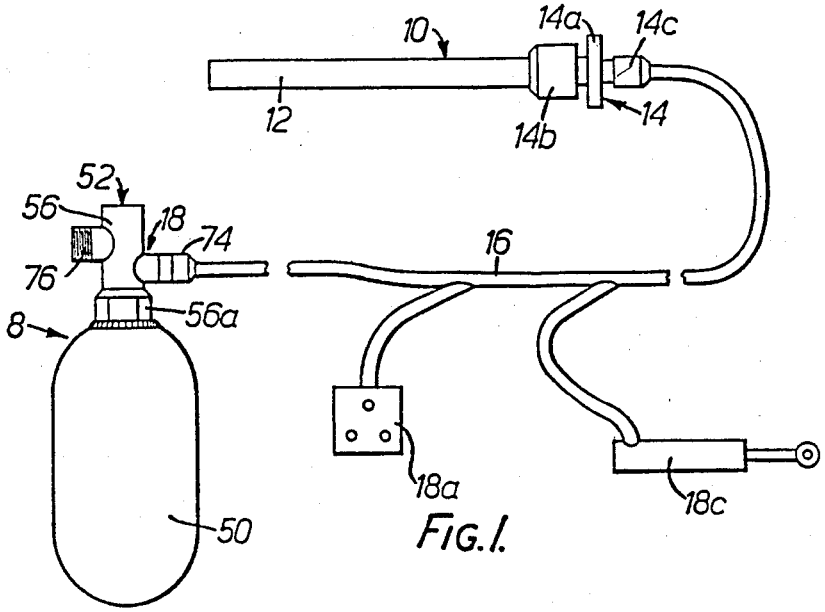
FIG. 1 is a diagrammatic representation of a fire protection system in accordance with the invention.

The basic components of the illustrated fire protection system include a fire extinguisher 8, a fire detection tube 10 containing a temperature responsive gas-evolving substance 40, a pneumatically operable actuation means 18 on extinguisher 8 for triggering the extinguisher and a conduit 16 connected by a coupling 14 to detector 10 for transmitting gas pressure to actuation means 18. Conduit 16 may be branched as shown by broken lines to transmit the gas pressure to other pneumatically operable devices such as a pneumatic electrical switch **18*a* or a pneumatic ram 18*c*** operatively associated with machinery under protection (not shown).

In a practical application, conduit system 16 and its branches may be part of a network of inter-connected conduits joining one or more detectors 10 to one or more devices including at least fire extinguisher actuation means 18. Detectors 10 may be mounted at critical points about machinery such as diesel engine plant and ram **18*c*** may be positioned, for example, to close fuel or air supply lines to the plant.

Figure 2:
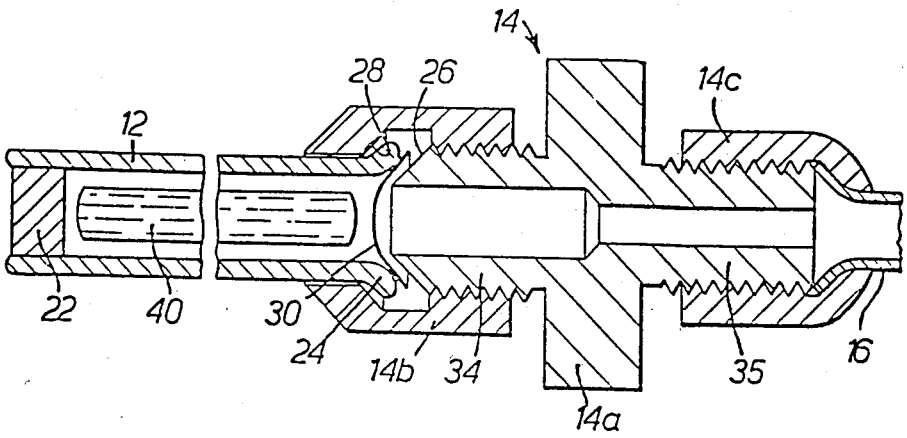
FIG. 2 is an axial cross-section of the detector component of the system shown in FIG. 1.

Detector 10 comprises a tube 12 which may be between a few centimeters and 25 meters or more in length and which may be straight (FIG. 2) or bent as appropriate. It is preferably of copper plated, hot tinned steel, closed at one end by a steel plug 22 welded into the mouth of the tube. The other end of tube 12 is flared at 24 to seat between matching annular tapered surfaces 26, 28 formed on the end of an adaptor **14*a* and sleeve 14*b* which make up coupling 12. Sleeve 14*b* is internally lipped at one end to afford surface 28 and internally screw threaded at the other end to complement a screw threaded spigot portion 34 of adaptor 14*a*. Adaptor 14*a* includes a second spigot portion 35 which is clamped to conduit 16 by a further sleeve 14*c*. To seal off and protect the interior of tube 12, a frangible diaphragm 30 is also clamped between surfaces 26,28**.

The interior of tube 12 contains a full or partial fill 40 of a temperature responsive solid gas evolving substance. Suitable substances include fast or slow igniter fuses and dried nitrocellulose solution. The substance, including its quantity, is selected to match a temperature range, say 150° to 250° C., at which a response is desired, as well as the overall dimensions of the system and the number, type and distance of the actuators to be operated. When a critical temperature within the chosen range, for example about 200° C., is attained about tube 12, substance 40 reacts, typically explosively, generating gas which breaches diaphragm 30 and fills conduit 16 and its branches to develop a gas pressure sufficient to operate the associated pneumatic devices including actuating means 18, switch 18*a* and ram 18*c*. The required pressure may, for example, be in the range 150 to 3,000 P.S.I. or more.

In a modification of the illustrated arrangement, adaptor 14*a* may carry an electrically operable fuse mounted at the inner face of diaphragm 30 for heating fill 40 and so allowing the detector to be manually triggered.

Figure 3:
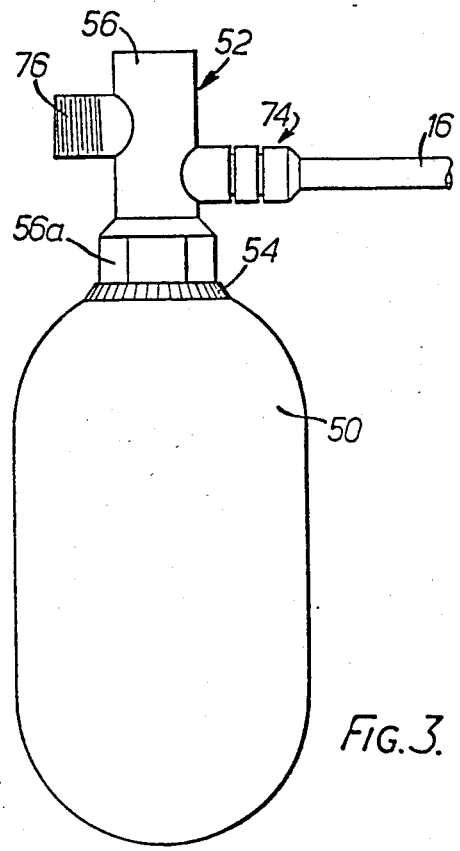
FIG. 3 is a side elevational view of the extinguisher component of the system shown in FIG. 1.
Figure 4:
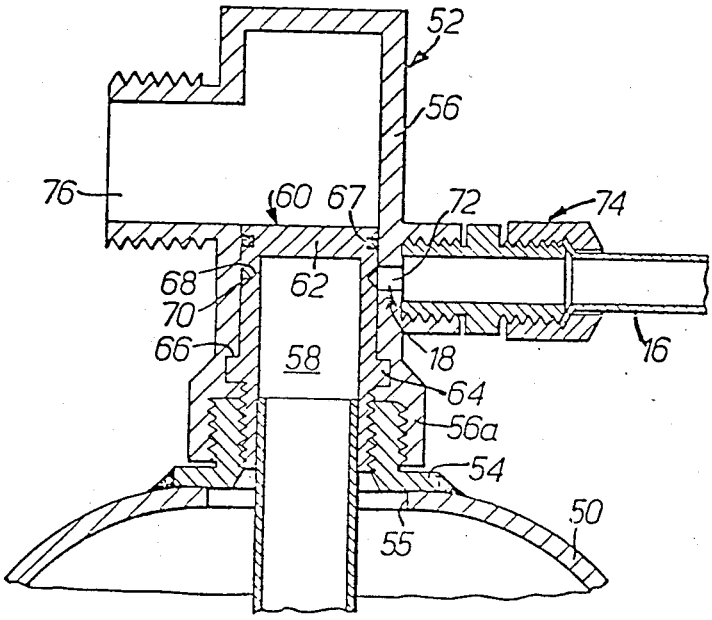
FIG. 4 is an axial cross-section of the head portion of the extinguisher.

Referring now to FIGS. 3 and 4, fire extinguisher 8 includes a high pressure vessel 50 for extinguishant and a head 52 atop the vessel. The head has a nipple 54 welded to vessel to vessel 50 about a port 55 in the vessel. Nipple 54 is externally screw threaded to receive an internally screw threaded socket portion 56*a* of an upstanding cover 56 which defines an outlet passageway 58 for extinguishant. This passageway is closed by a tubular plug member 60 which screw threadingly engages the interior of nipple 54 at its lower, open end and is closed by a solid partition 62 at its other end. An annular lip 64 on plug member 60 engages under a corresponding shoulder 66 on cover 56.

At its upper end, plug member 60 carries and O-ring 67 for sealing its engagement with cover 56. Actuation means 18 is located just below O-ring 67, and partition 62, and comprises an annular zone 68 of plug member 60 of reduced cross-section and surrounding matching annular cavity 70. Cavity 70 communicates via port 72 in cover 56 with a coupling assembly 74 secured to conduit 16. Assembly 74 is similar to coupling 14.

Transmittal of sufficient pressure via conduit 16 and port 72 to cavity 70 will be effective to rupture zone 68. The severed partition 62 will be forced upwardly by the pressurized extinguishant, which thus released may then pass laterally via port 76 to associated ducting (not shown).

Figure 5:
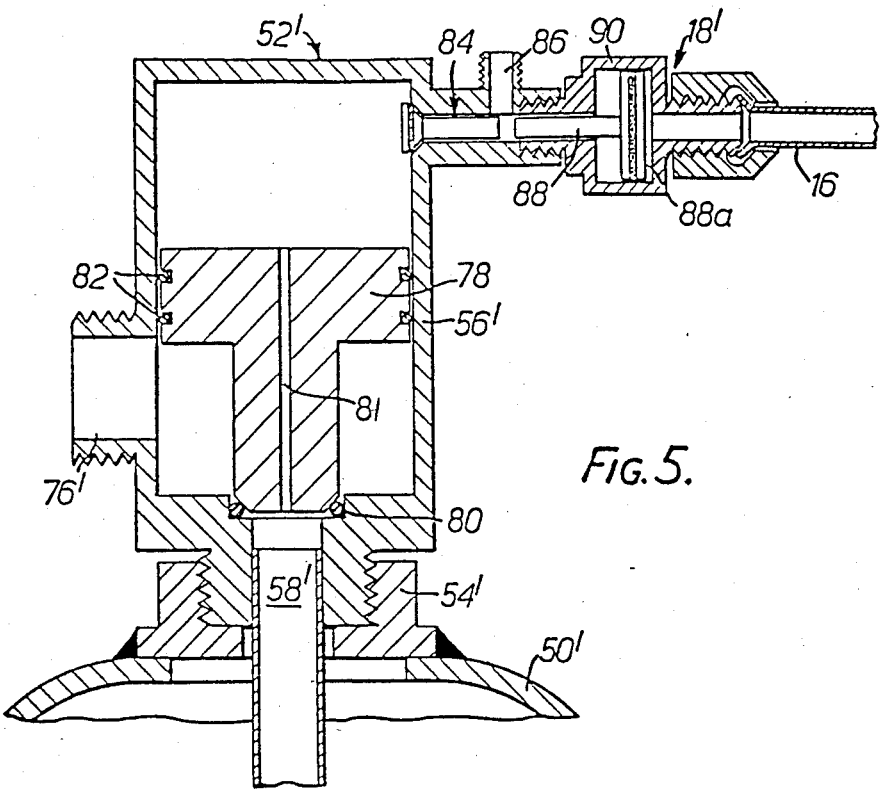
FIG. 5 is an axial cross-section showing an alternative construction of the extinguisher head portion.

In the FIG. 5 arrangement a cover 56' is again screw-threadingly engaged, albeit internally, with a nipple 54', welded to vessel 50'. A differential piston 78 is held against an O-ring seat 80 about an extinguishant outlet passageway 58' by extinguishant back pressure leaked via a capillary 81 in the piston. Paired O-rings 82 prevent loss of back pressure extinguishant.

Piston 78 is released by opening a bleed valve 84 to leak the back pressure to atmosphere at 86. To effect this, actuating means 18' comprises a plunger 88 moveable to open the bleed valve by pneumatic pressure applied via conduit 16 to a broad back face 88*a* of the plunger in a sealed cylinder 90.

In a further embodiment of the invention, not illustrated, the extinguishant outlet passageway is closed by a hollow cap of somewhat smaller diameter than the plug member shown in FIG. 4. The cap includes an annular frangible zone of reduced thickness and is arranged to be sheared off in this zone by a plunger responsive to pneumatic pressure in a detector connected conduit.

Figure 6:
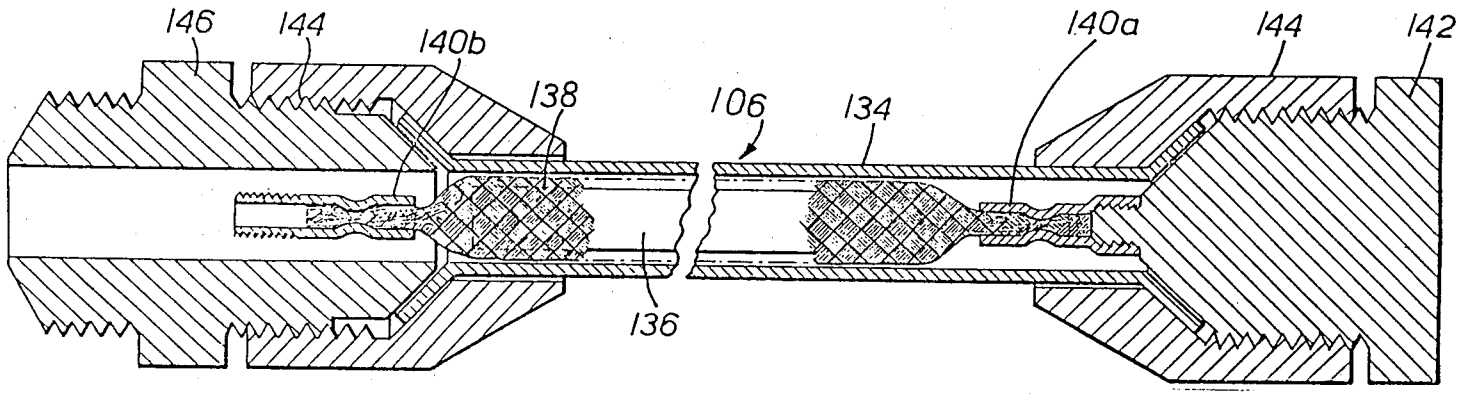
FIG. 6 is a section through a modified form of detector.

As shown in FIG. 6, the fire detector 106 comprises a tube 134 which may be between a few centimeters and 25 meters or more in length, the tube being of a heat conductive material such as copper-plated, hot-tinned, steel. The tube 134 is initially straight, but can be bent during installation in order to follow a desired path. When installed, the tube extends through a zone to be protected, for example the tube may be positioned on the wall or ceiling of a room so as to extend throughout the length of the room, or along machinery.

The interior of the tube 134 contains a temperature-responsive element 136 comprising a length of a gas-evolving temperature-responsive substance which extends substantially throughout the length of the tube 134, the element being flexible so that it can be bent with the tube 134. The substance may consist of a cotton wick impregnated with black powder and dried nitrocellulose solution. Alternatively, the substance may consist of a plastic igniter cord. A typical plastic igniter cord (fast) may comprise central paper strings coated with mealed black powder composition and held together with cotton countering; these are enclosed in an extruded layer of plastic incendiary composition and finished with an outer plastic covering. The substance reacts suddenly and explosively when the critical temperature is attained at any point along its length, the explosive reaction generating a large volume of gas at a pressure which may be within the range of 150 to 3000 psi or more, the pressure being controllable for each particular installation by using tubing of different diameters.

The element 136 is retained within a mesh sheath 138 which acts as a filter to retain solid combustion products and unburnt residue from the explosive reaction while permitting passage of gas through the mesh of the sheath. The sheath 138 is formed of metal wire for example of stainless steel or nickel steel so as to be heat resistant and to withstand the explosive reaction; preferably, the sheath 138 is formed from a braided wire mesh. At each end, the sheath 138 is closed by being crimped into a tubular end fitting 140*a*, 140*b*. The end fitting 140*a* at the end of the tube 134 remote from the conduit leading to the actuation means is internally threaded for connection to an inwardly-projecting threaded spigot of a threaded blanking plug 142 which closes the remote end of the tube 134 and which is screwed into a gland nut 144 held captive at that end of the tube. The proximate end of the tube 134, that is the end of the tube 134 which is closer to the conduit, is likewise provided with a captive gland nut 144 and this receives a tubular, externally-threaded, connector 146 by which the tube 34 can be connected to a further length of detector tube or to the conduit which leads to the actuation means. The crimped end fitting 140*b* for the sheath 138 at proximate end of the tube 134 is externally threaded and of a size to mate with the internal thread of an end fitting 140*a* similar to that used at the remote end of the tube 134. If the tube 134 is connected to a further length of detector tube, the externally-threaded end fitting 140*b* will be screwed into the internally threaded end fitting at the adjacent end of the temperature-responsive element associated with that other tube; if, however, the detector tube is connected directly to the conduit at is proximate end, the end fitting 140*b* is simply left free (as shown).

In use, when the temperature-responsive substance actuates explosively at the critical temperature, a large volume of gas in generated which passes through the wire mesh sheath 138 into the tube 134 and thence into the conduit in order to trigger the actuation means. However, the solid combustion products and unburnt residue are retained within the sheath 138 and do not enter the tube. In order to recommission the system after use, the blanking plug 142 is removed from the remote end of the tube 134 and the proximate end of the tube 134 is disconnected from the threaded connector 146 by unscrewing the gland nut 144 at that end of the tube. A new temperature-responsive element, complete with an outer wire sheath 138 and end fittings 140*a*, 140*b* is connected to the proximate end of the spent element by screwing the end fitting 140*a* of the new element onto the end fitting 140*b* of the spent element. The spent element is then withdrawn from the tube 134 through the open, remote, end of the tube, thus drawing the new element into the tube 134. When the spent element is fully withdrawn, it is disconnected from the new element, and the tube 134 is re-closed by screwing the plug 142 onto the end fitting 140*a* of the new element and screwing the gland nut 144 onto the plug 142. At the proximate end of the tube 134, the gland nut 144 is screwed onto the threaded connector 146.

It will be apparent that the use of the wire sheath avoids the need to clean the system after use as solid combustion products and any unburnt residue will be removed when the element is removed. The end fittings at each end of the sheath enable the element to be easily replaced in the manner described above, even if the tube 134 (or tubes 134) follow a tortuous path in the installation.

I claim:

1. A fire detector comprising an elongate tube of heat-conductive material, a temperature-responsive element housed within the tube, said element comprising a length of a gas-evolving substance effective when a predetermined critical temperature is reached at any point along the length of the element to explosively generate a volume of gas for activating pneumatic actuation means, a mesh sheath surrounding said length of gas-evolving substance, said sheath defining a filter to retain combustion products and unburnt residue of said substance, the temperature-responsive element further comprising an end fitting at each end of the sheath, the end fitting at one end of the sheath being externally threaded and the end fitting at the other end of the sheath being internally threaded, the internal and external threads being complementary whereby two such temperature-responsive elements may be coupled by engaging the externally-threaded end fitting of one of said elements with the internally-threaded end fitting of the other of said elements.

2. A fire detector comprising an elongate tube of heat-conductive material, a temperature-responsive element housed within the tube, said element comprising a length of a gas-evolving substance effective when a predetermined critical temperature is reached at any point along the length of the element to explosively generate a volume of gas for activating pneumatic actuation means, a mesh sheath surrounding said length of gas-evolving substance, said sheath defining a filter to retain combustion products and unburnt residue of said substance, the temperature-responsive element further comprising an end fitting at each end of the sheath, the end fitting at one end of the sheath being externally threaded and the end fitting at the other end of the sheath being internally threaded, the internal and external threads being complementary whereby two such temperature-responsive elements may be coupled by engaging the externally-threaded end fitting of one of said elements with the internally-threaded end fitting of the other of said elements, and further comprising removable plug menas closing one end of the tube, said plug means including a threaded portion for connection with the threaded end fitting at the adjacent end of the temperature-responsive element.

3. A fire protection system comprising at least one fire extinguisher, pneumatically-operated actuation means for said fire extinguisher, and a first detector, said fire detector comprising an elongate tube of heat-conductive material, a temperature-responsive element housed within said tube, said element comprising a length of a gas-evolving substance effective, when a predetermined critical temperature is reached at any point along the length of the element, to explosively generate a volume of gas, and a mesh sheath surrounding said length of gas-evolving substance, said sheath forming a filter to retain combustion products and unburnt residue of said substantce, said tube being closed at one end, and conduit means connecting the other end of said tube to said actuation means whereby said volume of gas when generated actuates said actuation means, the temperature-responsive element further comprising a respective end fitting closing each end of the sheath, said end fitting being threaded, wherein one of said end fittings is externally threaded and the other of said end fittings is internally threaded, the threaded end fittings being complementary whereby two such temperature-responsive elements may be connected in end to end relationship by engaging the externally-threaded end fitting of one such element with the internally-threaded end fitting of the other such element.

* * * * *